US006928754B2

(12) United States Patent
Cambronero

(10) Patent No.: US 6,928,754 B2
(45) Date of Patent: Aug. 16, 2005

(54) DETACHABLE STRAPS CONNECTION TO A SHOE BOTTOM

(76) Inventor: Enrique Martinez Cambronero, Alcala, 169, E-28009 Madrid (ES)

( * ) Notice: Subject to any disclaimer, the term of this patent is extended or adjusted under 35 U.S.C. 154(b) by 0 days.

(21) Appl. No.: 10/467,419

(22) PCT Filed: Jan. 10, 2002

(86) PCT No.: PCT/ES02/00011

§ 371 (c)(1),
(2), (4) Date: Jan. 16, 2004

(87) PCT Pub. No.: WO02/062167

PCT Pub. Date: Aug. 15, 2002

(65) Prior Publication Data

US 2004/0128859 A1 Jul. 8, 2004

(30) Foreign Application Priority Data

Feb. 8, 2001 (ES) ..... 0100303 U

(51) Int. Cl.[7] ..... A43B 3/12
(52) U.S. Cl. ..... 36/11.5; 36/100; 36/101
(58) Field of Search ..... 36/11.5, 15, 100, 36/101

(56) References Cited

U.S. PATENT DOCUMENTS

| | | | | | |
|---|---|---|---|---|---|
| 2,368,314 | A | * | 1/1945 | Marx | 36/11.5 |
| 2,526,940 | A | | 10/1950 | Fello | |
| 2,607,133 | A | * | 8/1952 | Marlowe | 36/11.5 |
| 2,761,224 | A | | 9/1956 | Gardiner | |
| 2,976,623 | A | | 3/1961 | Gallaway | |
| 3,890,725 | A | * | 6/1975 | Lea et al. | 36/11.5 |
| 4,497,123 | A | * | 2/1985 | Ehrlich | 36/32 R |
| 4,839,948 | A | * | 6/1989 | Boros | 24/662 |
| 4,887,369 | A | * | 12/1989 | Bailey et al. | 36/101 |
| 5,454,382 | A | * | 10/1995 | Tariah et al. | 128/882 |
| 5,896,684 | A | * | 4/1999 | Lin | 36/101 |
| 5,992,058 | A | | 11/1999 | Jneid | |
| 6,581,255 | B2 | * | 6/2003 | Kay | 24/640 |
| 2002/0194750 | A1 | * | 12/2002 | Feick | 36/101 |
| 2003/0074806 | A1 | * | 4/2003 | Urie et al. | 36/11.5 |

FOREIGN PATENT DOCUMENTS

| | | |
|---|---|---|
| FR | 2568453 | 2/1986 |

* cited by examiner

*Primary Examiner*—M. D. Patterson
(74) *Attorney, Agent, or Firm*—Duane Morris LLP

(57) ABSTRACT

The invention relates to a detachable straps connection to a shoe bottom, which involves making recesses in the side areas in the platform or bottom (2) that is made of any given material in such a way that two of said recesses may or may not face another two recesses. Each recess (6) has a centered bottom blind bore, a tubular part or bar (7) being placed in the inner area of said bore. A closing section (8) is mounted and/or fixed to an inner end part of said bar, said closing section defining the male part (9) of the push-in coupling element to the female area (10) of the end rivet. Each of the straps (11) of the cut-off are placed in said female area. The tubular parts (7) extend at different lengths transversally, longitudinally or slanted.

7 Claims, 2 Drawing Sheets

DETACHABLE STRAPS CONNECTION TO A SHOE BOTTOM

OBJECT OF THE INVENTION

The present specifications refers to a detachable fastening for attaching straps to the sole of a shoe, more specifically, for the detachable attachment of straps of the upper part of a shoe, with the additional feature that the user, usually a woman, can change the parts making up the upper part of the shoe whenever she wants, depending on the type of clothes she is wearing for each particular occasion, without the need to use screws to secure the tenon part of the fastener.

FIELD OF THE INVENTION

Application of this invention is included in the industry for shoe manufacture.

BACKGROUND OF THE INVENTION

At present, women wear a different type of shoe for different types of clothing, and this can make buying footwear quite costly, sometimes resulting in considerable amounts.

When a woman buys a pair of shoes, although she likes the overall design, she may not always like a part of the upper of the shoe or fastening.

And, although she is ready to accept this, it always means there is a negative aspect for the user.

The applicant is aware of a Utility Model that exists, under application No. 200002749/0, for a detachable device for fastening straps of the upper part of a shoe, which has indents situated at regular intervals facing each other along opposite sides of the part making up the platform or sole.

Centred in the bottom of each indent is a small closed-off bore hole, and each indent also has, on its outer-facing edge, a round press stud in which a washer sits, in the centre of which is a slightly-raised projected cylindrical area, which also has a rim folding inwards, with a smaller diameter than the washer bore hole, which is where the head of a threaded screw fits inside the closed-off bore hole in the bottom of the indent.

The abovementioned device does in fact have one serious drawback in that the production costs are high and the manufacturing process difficult since a screw must be inserted inside the closed-off bore hole in the bottom of the indent.

DESCRIPTION OF THE INVENTION

The detachable fastening for attaching straps to the sole of a shoe recommended herein, has been designed to solve this problem entirely, by using a solution that is both simple and effective.

To be more precise, the detachable fastening for attaching straps to the sole of a shoe object of the invention, has the special feature of having a series of bars or resistant tubes on the shoe platform, either positioned in rows of bore holes or not, some of which run across the longitudinal axis of the platform, with closing sections being fitted into the inner ends of the bars or tubes, which respectively define the tenon part of the press stud with the corresponding mortise part of the end rivet, which are mounted on each of the straps of the upper of the shoe.

The bars or tubes run across the shoe, lengthways and diagonally, and can vary in length, thereby avoiding the need for a threaded screw inside the closed-off bore hole in the bottom of the indent.

The invention solves all the problems currently known, significantly reducing the production costs and making the manufacturing process simpler, as well as enabling the user to fully or partly modify or replace the upper part of the same shoe whenever she wishes, substituting the parts for others of different shapes and/or colours.

Replacement is simple, easy and safe, due to the type of attachment and removable fastening of each of the parts of the shoe upper.

The invention is suitable for use with any type of lady's shoe, whether it be in the form a clog or a shoe with a high or low heel.

In this invention, the shoe has a sturdy structure with a high, medium or low-heeled platform or sole, which can be made of wood or other resistant material, with indents situated at regular intervals along the sides, so that they are, or are not, opposite each other.

Centred in the bottom of each indent is a small closed-off bore hole, with a bar or resistant tube inside, on the inner end of which a closing section is mounted and/or fixed, defining the tenon part of the press stud, with the corresponding mortise part of the end rivet, which are mounted on each of the straps of the upper of the shoe.

Said bars or tubes run across the shoe, as well as lengthways and diagonally, the latter being of variable length.

The aforementioned double fastener makes the removable attachment safe to use and suitable for withstanding pressure exerted by the foot on all parts of the strap or shoe.

DESCRIPTION OF THE DRAWINGS

As an accompaniment to the description being made herein and to provide a better understanding of the characteristics of the invention, a set of drawings are attached to the present specification, as an integral part thereof, which represent, in an illustrative but non-limitative way, the following.

PREFERRED EMBODIMENT OF THE INVENTION

Figure 1:
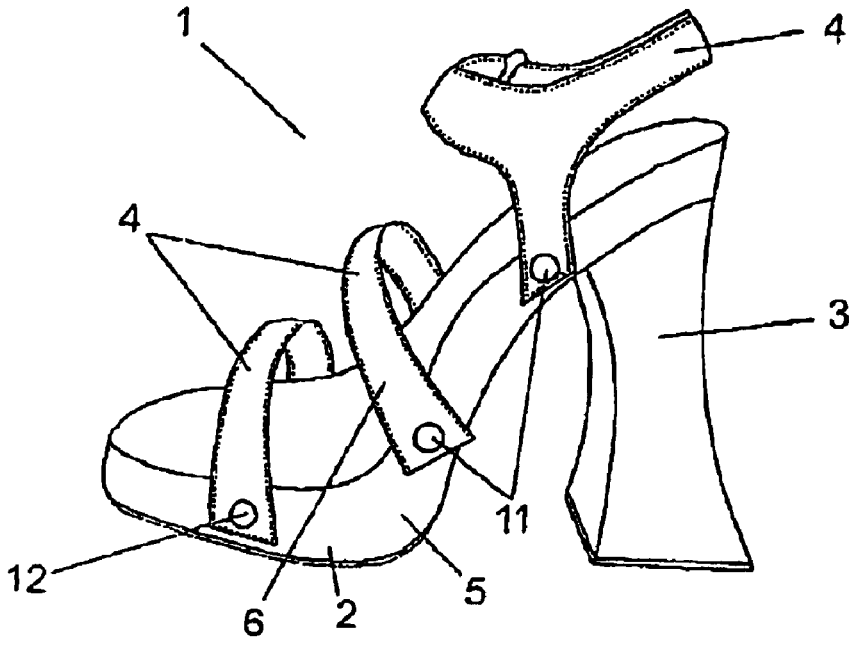
FIG. 1—Shows a perspective view of a shoe incorporating the invention, comprising a detachable fastening for attaching straps to the sole of a shoe.
Figure 2:
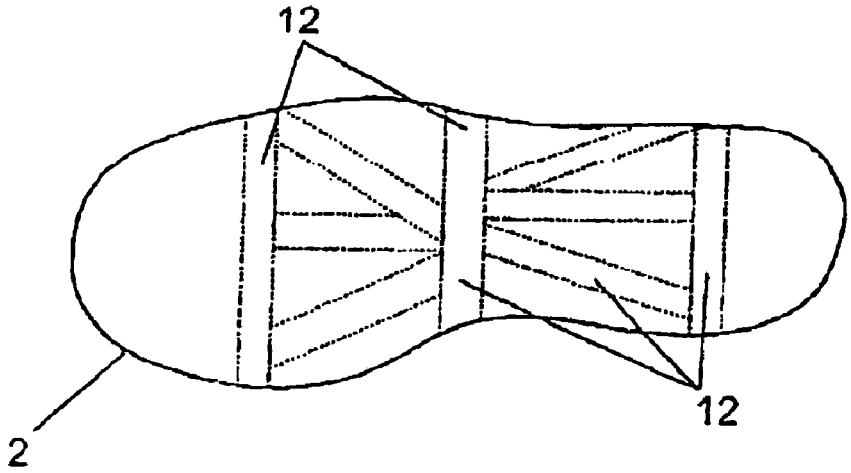
FIG. 2—Shows an elevational view of the base of the shoe, with the bars or resistant tubes.
Figure 3:
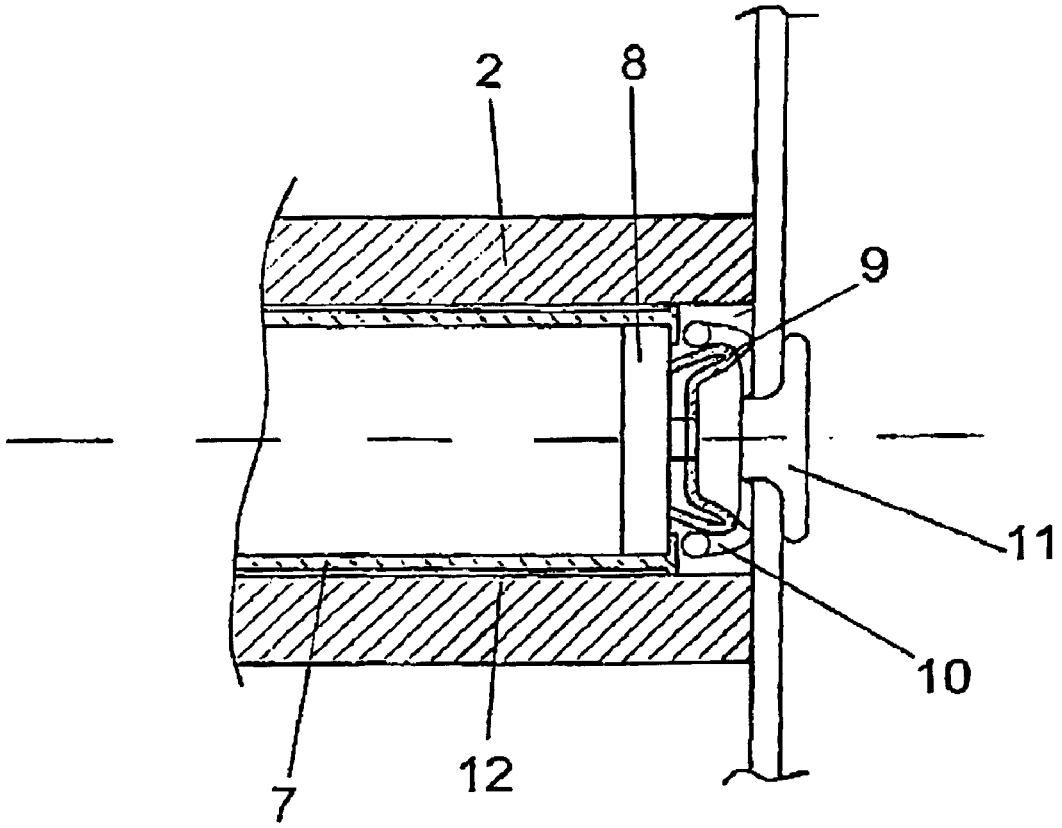
FIG. 3—Is a cross-sectional view of one of the fastening points of the straps of the upper to the platform or sole of the shoe.

Looking at the figures, it can be seen how the detachable fastening (11) for attaching straps to the sole of a shoe, is made up of a lady's shoe (1), of the type with a platform or sole (2), a heel (3) and an upper (4).

On the platform (2) is a series of bars or resistant tubes (7), positioned in rows of bore holes (12) or not, some of which run across the longitudinal axis of the platform, with closing sections (8) being fitted into the inner ends of the bars or tubes, which respectively define the tenon part (9) of the press stud with the corresponding mortise part (10) of the end rivet, which are mounted on each of the straps (6) of the upper (4) of the shoe.

The dual mortise and tenon joint provides the detachable fastening (12) for attaching each strap (6) of the upper (4) of the shoe to the sides (5) of the platform or sole (2), and this fastening can be easily detached, allowing the straps (6) to be quickly replaced by others of different colours and/or shapes, allowing the user to change the upper of the shoe whenever she wishes.

What is claimed is:

1. In a shoe having a sole, a heel, an upper formed by straps, and a detachable fastening for attaching the straps to the sole of the shoe, the improvement comprising:

a plurality of bore holes inside the sole, the bore holes running across a longitudinal axis of the sole, the bore holes housing a plurality of bars or a plurality of resistant tubes;

the bars or tubes having inner ends wherein closing sections are fitted;

the closing sections having a tenon part defined therein; and detachable fastening means at the ends of the straps, the detachable fastening means having a mortise part.

2. The shoe of claim 1, further comprising additional bars or tubes running across the shoe, lengthways.

3. The shoe of claim 2, wherein the additional bars or tubes have a plurality of different lengths.

4. The shoe of claim 1, further comprising additional bars or tubes running across the shoe, diagonally.

5. The shoe of claim 4, wherein the additional bars or tubes have a plurality of different lengths.

6. The shoe of claim 1, wherein at least one of the bores extends from a first lateral side of the shoe to an opposite lateral side of the shoe.

7. The shoe of claim 1, wherein the detachable fastening means are integrally fixed to the ends of the straps.

* * * * *